US011400338B1

(12) United States Patent
Farina

(10) Patent No.: US 11,400,338 B1
(45) Date of Patent: Aug. 2, 2022

(54) PILATES EXERCISE DEVICE AND METHOD

(71) Applicant: Karen Farina, Temecula, CA (US)

(72) Inventor: Karen Farina, Temecula, CA (US)

( * ) Notice: Subject to any disclaimer, the term of this patent is extended or adjusted under 35 U.S.C. 154(b) by 0 days.

(21) Appl. No.: 17/558,142

(22) Filed: Dec. 21, 2021

Related U.S. Application Data

(60) Provisional application No. 63/247,628, filed on Sep. 23, 2021.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/035*** | (2006.01) |
| ***A63B 23/12*** | (2006.01) |

(52) U.S. Cl.
CPC ..... *A63B 21/4029* (2015.10); *A63B 21/0442* (2013.01); *A63B 21/0552* (2013.01); *A63B 21/4039* (2015.10); *A63B 23/03541* (2013.01); *A63B 23/12* (2013.01); *A63B 2209/00* (2013.01)

(58) Field of Classification Search
CPC ..... A63B 21/0442; A63B 21/0552; A63B 21/4029; A63B 21/4039; A63B 23/03541; A63B 23/12; A63B 2209/00
See application file for complete search history.

(56) References Cited

U.S. PATENT DOCUMENTS

| | | | | |
|---|---|---|---|---|
| 4,706,953 | A * | 11/1987 | Graham | A63B 21/4009 482/133 |
| 4,884,802 | A * | 12/1989 | Graham | A63B 21/04 482/130 |
| 5,042,797 | A * | 8/1991 | Graham | A63B 22/001 482/110 |
| 5,312,315 | A * | 5/1994 | Mortensen | A63B 21/0087 482/148 |
| 7,682,297 | B2 * | 3/2010 | Graham | A63B 23/0405 482/121 |
| 7,871,358 | B2 * | 1/2011 | Graham | A63B 23/0405 482/142 |
| 8,394,005 | B2 * | 3/2013 | Solow | A63B 21/023 482/121 |
| 10,022,579 | B1 * | 7/2018 | Graham | A63B 22/0087 |
| 11,148,003 | B1 * | 10/2021 | Graham | A63B 21/0552 |
| 2007/0087921 | A1 * | 4/2007 | Graham | A63B 21/055 482/142 |
| 2010/0004101 | A1 * | 1/2010 | Solow | A63B 21/068 482/96 |
| 2013/0244844 | A1 * | 9/2013 | Solow | A63B 23/035 482/142 |
| 2018/0169464 | A1 * | 6/2018 | Janowski | A63B 21/22 |
| 2019/0269965 | A1 * | 9/2019 | Hicks, II | A63B 21/154 |
| 2021/0298980 | A1 * | 9/2021 | Thek | A63B 21/0552 |

* cited by examiner

*Primary Examiner* — Joshua Lee
(74) *Attorney, Agent, or Firm* — Donn K. Harms

(57) ABSTRACT

A supporting device for users of a pilates exercise machine to maintain them at an inclined angle upon the platform or carriage of the exercise machine during use. The device features a body having a bottom adapted for positioning on the moving or stationary carriage of the pilates machine and an inclining top surface to support the body of the user inclined.

15 Claims, 9 Drawing Sheets

PILATES EXERCISE DEVICE AND METHOD

This application claims priority to U.S. Provisional Patent Application Ser. No. 63/247,628 filed on Sep. 23, 2021 which is incorporated herein in its entirety by this reference thereto.

BACKGROUND OF THE INVENTION

1. Field of the Invention

The present invention relates generally to Pilates exercise. More particularly, it relates to a Pilates exercise method and body support device configured to provide inclined supine positioning of the user during Pilates exercise either on the body of the device or on a moving or stationary carriage or table of a Pilates apparatus.

2. Prior Art

Pilates is an exercise regimen which employs controlled movements using Pilates equipment or a Pilates apparatus. The controlled movements are adapted to help a person improve flexibility, build strength, and to develop control and endurance in the entire body. Conventionally, Pilates puts an emphasis on body alignment, breathing, the development of a strong core, and the improvement of coordination and balance. Exercising the core, which includes the muscles of the abdomen, back, and pelvis during Pilates, is conventionally thought to be the key to a person's stability.

The Pilates system and devices therefor, allow for different exercises to be accomplished by the user. These exercises can be modified in a range of difficulty from beginner to advanced or to other levels, depending on the instructor and practitioner's specific goals and/or limitations. Exercise intensity is generally increased over time as the body adapts itself to the exercises.

The term equipment is not generally employed in describing Pilates exercising, as such is more often term a Pilates apparatus. One widely employed Pilates apparatus is known conventionally as a Reformer. The Reformer apparatus was invented by Joseph Pilates, the founder of the Pilates exercise movement, as one of the primary pieces of Pilates apparatuses. The reformer apparatus is a bed-like frame with a flat support platform, also called a carriage, which rolls back and forth on wheels, operatively positioned between the platform and the frame.

Reformer apparatuses are manufactured by a wide number of manufacturers, but all are configured to be employed in a similar mode of operation. Springs or other biasing means are operatively connected with the frame, and the carriage can be set to provide movement assistance or movement resistance to aid the user in achieving proper muscle length and strength in an organized way.

The user of the Reformer apparatus, when lying upon the platform or table, is generally in a supine positioning of their body upon the substantially planar translating table. For users who have various physical limitations, such a supine planar positioning may not be comfortable or healthful. Other Pilates apparatuses can include ropes in a pulley system, metal springs, and bands which are elastic in operation, all provided with a number of different resistance tensions. These may all be employed to provide resistance exercise, during a Pilates exercise session, in combination with the device herein.

Other Pilates apparatuses and components can include Pilates bands, which are elastic in operation and are provided in a number of differing lengths and resistance tensions. These bands are employed to provide resistance during Pilates exercises.

The forgoing examples of related art in the field of Pilates exercise and the apparatus employed during such exercise, and limitation related therewith, are intended to be illustrative and not exclusive, and they do not imply any limitations on the inclined positioning Pilates invention described and claimed herein. Various limitations of the related art will become apparent to those skilled in the art upon a reading and understanding of the specification below and the accompanying drawings.

SUMMARY OF THE INVENTION

The device herein disclosed and described provides a Pilates apparatus which is configured to provide both a device and method for users to be enabled to easily assume an inclined positioning of their body during Pilates exercise on a carriage or platform of a Pilates exercise apparatus. The Pilates exercise device herein has a body which is adapted, on a bottom or lower surface, to sit upon the carriage or supporting platform used in a wide variety of existing Pilates exercise systems. Such Pilates exercise devices are available from a number of manufacturers and conventionally have a translating carriage or platform on which a user is positioned. As an example and in no way limiting, the Pilates Reformer employs such a translating carriage, while a Pilates Trapeze Table may include a stationary planar support surface for the carriage.

An upper surface of the body, opposite the base thereof, is configured to form a support against the back of a user positioned upon it. This upper surface is inclined. In a particularly preferred mode of the device herein a slight recess of the upper surface is formed in a central portion of the inclined upper surface.

Along a central area of the inclined upper surface is located a friction enhancing strip. The friction enhancing strip can extend across a central portion of the upper surface, or more preferably, to maximize the non-slip attributes the strip provides, the friction enhancing strip can extend between a lower edge of the upper surface to an upper edge of the upper surface. Users positioned in an inclined position supported by the upper surface are thus substantially prevented from slipping downward by the enhanced frictional engagement between the friction enhancing strip and the back of the user or their clothing worn on the back.

The upper surface can be planar with and run at a continuous inclined angle relative to the planar lower surface. Currently, an angle between 20 degrees and 40 degrees is preferred, with an angle substantially between 30 degrees and 34 degrees being especially preferred. This preferred angle, in experimentation, appeared to provide the most comfortable positioning to the most users.

In an alternative but preferred configuration, the upper surface has a first body portion thereof extending from the lower edge to a central portion of the upper surface. This first portion of the upper surface is substantially planar and runs at the preferred angle. In a second body portion of the upper surface, adjacent the first portion thereof, a curved recess is formed in the upper surface of the body of the device. This curved recess forms a slight dip for the length of the second portion of the upper surface. Extending from the upper edge of the upper surface to the end of the second portion of the upper surface is a third portion of the upper surface. This third portion can continue the angle of the first portion of the upper surface, or more preferably, the angle of the third portion will be increased 3-5 degrees from that of the first portion of the upper surface to more comfortably support the upper back of a user positioned thereon.

A removably engageable lumbar cushion may be provided which is positionable to a removable attachment with the first portion of the upper surface of the body of the device. The lumbar cushion, preferably, has a curved exposed surface adapted for contact against the lumbar area of the user positioned on the device. The removable engagement may be provided by hook and loop fabric, operatively positioned on the lower surface of the lumbar cushion and the first portion of the upper surface of the body of the device.

A removably engageable head cushion may also be provided. This head cushion has an exposed surface when mounted which is configured to contact against the neck and head region of the user positioned on the upper surface of the body of the device. This head cushion is removably engageable to the third portion of the upper surface between the upper edge and the second portion of the upper surface. In the same fashion as the lumbar cushion, removable engagement of the head cushion may be provided by hook and loop fabric operatively positioned on the lower surface of the head cushion and the third portion of the upper surface of the body of the device.

The body of the device is preferably covered with a soft covering layer, such as vinyl material, leather or synthetic leather, with padding positioned between the body and the covering layer. The body itself is preferably formed in a light weight material with hollow cavities between the upper surface and the bottom edge or surface which is configured for operative contact with support such as a floor, or as noted, the carriage of a Pilates Reformer apparatus or upon a stationary Pilates Trapeze Table. Such a material may be polymeric material, wood, fiberglass, carbon fiber, combinations of some thereof, or other lightweight but strong materials as would occur to those skilled in the art.

Where the body is formed of foam material the density of the foam material conventionally determine a hardness of the body and surfaces thereof. A foam density will be between 1.00 bs per cubic foot (PCF) and 4.00 PCF is preferred to provide users with a comfortable support to their body during contact and use. The 1.0 lb is the lowest possible and, while employable, it is at the lower end of "softness" for use. The 4.0 lb foam material would be at the high end of the spectrum and would be very firm, but may be too firm for some users. A particularly preferred range of foam density for use to form the body of the device would be between 1.5 pounds per cubic foot to 2.5 pounds per cubic foot for most users.

The device herein can also include fixed mounts positioned upon the body of the device which are configured for engagement to resistance components such as for example, elastic band or spring resistive, or other such resistance exercise components. The fixed mounts may be located upon a vertical rear wall of the body of the device. Such mounts preferably have openings or other connectors which are configured for the connection of one end of the resistive exercise component such as an elastic exercise band therewith. This allows the user of the device herein, while in a supine inclined positioning upon the upper surface of the body of the device herein, to employ the resistive exercise components for conventional Pilates exercise.

By resistive exercise components herein is meant, for example and in no way limiting, ropes in a pulley system, springs, elastic bands, or other resistive exercise components as would occur to those skilled in the art. Preferably, such resistive exercise components include a means to adjust and set them to any of a plurality of different resistance tensions.

The body of the device herein is positionable on the translating table or platform of a Pilates apparatus, such as the widely sold and employed Reformer or upon the stationary table of a conventional Pilates Trapeze Table. As used herein, the term Pilates apparatus or Pilates exercise device means any Pilates type exercise device, manufactured by any manufacturer which has either a stationary platform for Pilates exercising, or has a translating table or platform for body support. Such Pilates exercise devices and apparatuses are manufactured, for example, but in no way limiting, by manufacturers such as Balanced Body, Body Arts and Science International, Clinical Pilates, Elina Pilates, Gratz Pilates, Peak Pilates, Stamina, and Stott Pilates.

Using the device and method herein, when operatively positioned on the platform of such Pilates exercise devices, the user may exercise using a Pilates Reformer device or the Pilates Trapeze Table in the normal fashion. However, during such exercise, the user will enjoy an inclined supine positioning with their back well supported in an inclined position on the support surface, such as a Pilates machine platform.

Additionally, in an OEM mode of the device herein the body of the device herein can be formed as an integral part of a the platform supporting the body of a user on a conventional Pilates exercise device. Such may be a permanently inclined platform or can be a platform configured with hinges or pivots and the like, allowing a portion thereof, supporting the head and back of a user, to be inclined. So provided, the body of the device herein may extend from the top surface of the moving platform or carriage of a Pilates apparatus, such as a conventional Pilates Reformer, or as part of the support platform of a conventional Pilates Trapeze table or as part of similar conventional Pilates apparatuses made by any manufacturer, rather than just as a separate body.

With respect to the above description, before explaining at least one preferred embodiment of the herein disclosed Pilates apparatus having inclined user support in detail, it is to be understood that the invention is not limited in its application to the details of construction and to the arrangement of the components in the following description or illustrated in the drawings. The Pilates exercise apparatus herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based, may readily be utilized as a basis for designing of other inclined positioning Pilates exercise apparatuses and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Finally, the term "substantially" if not otherwise defined, means plus or minus ten percent.

It is an object of this invention to provide an inclined support for a user during Pilates exercises through the provision of a means for modifying traditional planar supine positioning of a user on a Pilates platform or table, during exercises to an inclined supine position.

It is a further object of this invention to provide such an inclined support for users during Pilates exercise which is formed of a body which may be supported on a floor or the like, or is operatively positionable upon a supporting surface of the carriage or platform of conventional Pilates exercise apparatus, such as the translating table of a conventional Pilates Reformer or the table of a Pilates Trapeze table.

It is yet another object of this invention to provide an inclined surface for positioning of a user thereon, where the inclined upper surface is operatively positionable on a moving carriage or stationary table of a conventional Pilates apparatus.

It is a further object of this invention to provide a method for providing the inclined positioning of users positioned on the translating platform of any Pilates exercise device or apparatus using an engageable inclined platform herein, an OEM platform for the user to lay upon which is inclined, or an OEM platform on a Pilates apparatus which includes pivots or bends or the like allowing a head and back support portion thereof to be positioned in an incline.

Other objects, features, and advantages of the presently disclosed device and method for inclined support for Pilates exercise, as well as the advantages thereof over existing prior art, will become apparent from the description to follow, and are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive, examples of embodiments and/or features of the disclosed device. It is intended that the embodiments and figures disclosed herein are to be considered illustrative rather than limiting.

In the drawings:

FIG. 9 shows the device herein operatively positioned with the base of the body located on a translating table of a Pilates Reformer or the like.

Figure 1:
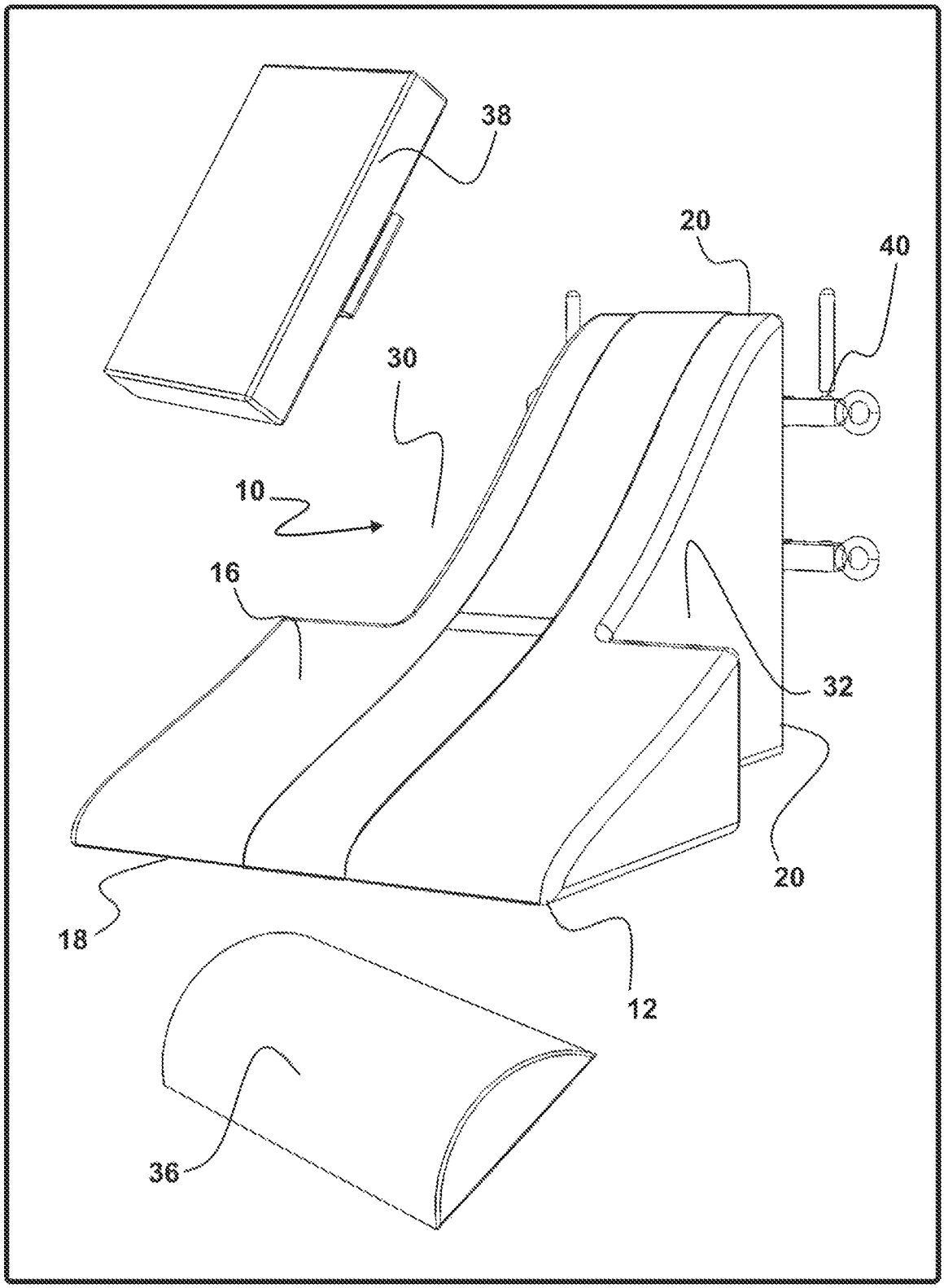
FIG. 1 depicts the device from a front perspective view showing a body of the device having an inclined upper surface and showing engageable optional components thereto.

Other aspects of the presently disclosed Pilates exercise invention and method of employment thereof, shall be more readily understood when considered in conjunction with the accompanying drawings, and the following detailed description, neither of which should be considered limiting.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the post engageable table device as it is oriented and appears in the drawings and are used for convenience only, and they are not intended to be limiting or to imply that the inclined Pilates support device herein has to be used or positioned in any particular orientation.

Now referring to drawings in FIGS. 1-16, FIG. 1 depicts the device 10 herein from a front perspective view. As shown, the device 10 has a body 12 which, as shown in other side views, has a generally triangular shape, with a bottom 14 and an inclined or upward-angled top surface 16. The top surface 16 angles upward from a lowest point at a first end 18 of the body 12 where the top surface 16 will substantially intersect with a support surface, such as a carriage or platform 24, such as a Pilates machine 22 platform 24 (FIGS. 9-10 and 13-14). The top surface 16 angles upward to a highest point above the support surface at a second end 20 of the body 12. By platform 24 is meant any carriage or moving or stationary support on which a user is positioned on a conventionally available Pilates exercise device, such as, for example only, the carriage of a Pilates Reformer.

It should be noted that there may be a curved recessed area 26 (FIGS. 5-6) in a central potion of the top surface 16 in between the first end 18 and second end 20 of the body 12. Such is formed by a slightly curving top surface 16 having a first angle of incline A along a line substantially along the first portion of the top surface 16 to a central area of the top surface 16. In the central area where there is shown positioned a curved recess 26, the second inclining angle A1 extends toward the second end 20 at a steeper second angle of incline A1 than the first angle of incline A.

Currently the first angle of incline A is between 20-40 degrees relative to the substantially planar support surface 28 which supports the bottom surface 14, with an angle of 30-34 degrees being especially preferred. Currently the second angle of incline runs at 35-45 degrees along an imaginary line intersecting the planar support surface with a second angle of incline A1 42-45 degrees being especially preferred.

These are preferred as the smaller incline angle A, at the first end 18 of the body 12 which is wider than the second end 20 of the body 12, will provide a gradual incline and wide support area for the lower back of the user adjacent the support surface. The increase in angle of the second angle of incline A1 provides better support to the upper back and neck of the user in a more upright and comfortable position.

Shown in FIGS. 1-6 are the configuration of the body 12 in all modes of the device. A first body portion 23, extending between the first end 18 and the central area of the body 12, where the recessed area 26 is positioned, is wider than a second body portion 25. This second body portion 25 extends from a side of the first body portion opposite the first end 18 to the second end 20. As shown, the second body portion 25 also may extend from the central or recessed area 26 to the second end 20 of the body 12.

While shown as a unitary structure in the drawings herein the body 12 can be formed in two pieces where the second body portion 25 connects to a central area of the first body portion 23 and extends therefrom. This configuration may be easier to store when not in use. As such, where the body 12 is described herein as having the first body portion 23 and second body portion 25 extending from a central area of the first body portion 23, such is meant to include a body 12 formed in a unitary or single structure or a body 12 formed of the first body portion 23 connected to the second body portion 25 such as with hook and loop fabric or other separable fasteners.

The width W1 of the first body portion 23 of the body 12 across the first end thereof at the first end 18 of the body 12 extending to the opposite side of the first body portion 23 is substantially 2 to 3 times the width W2 of the centrally positioned second portion 25 of the body 12. The second body portion 25 extends in between a second side of the first body portion 23 opposite the first end 18 of the body 12, second end 20 of the body 12, from a central area of the first body portion 23. By central area is meant that the second body portion 25 is positioned extending from the second side of the first body portion at a position substantially centered between the first side surface 46 at the first body portion 23 and the second side surface 48 of the first body portion 25.

This configuration, with a wider first body portion 23 and narrower second body portion 25 of the body 12 forms what might be defined as an inverted "T" shape to the body 12, when viewed from overhead. This shape is particularly preferred, because it defines a first side space 30 running along a first side of the second body portion 25 of the body 12 in between said first body portion and said second end 20 of said body 12. It also has a second side space 32 running along a second side of the second body portion 25 of the body 12 opposite the first side space 30, in between said first body portion and said second end 20 of said body 12.

These two opposing side spaces are particularly preferred in that they provide the inclined user, operatively positioned atop the top surface 16 of the device 10, respective voids or spaces for positioning of one respective arm in each of the first side space 30 and second side space 32 during use. This allows the user, ergonomically positioned with their back upon the top surface 16, to properly position and move their arms during use, such as to pull upon handles and resistive bands 33 (FIGS. 11-12) for arm exercise, along with areas for pulling upon platform engaged tethers 34 (FIGS. 9-10) used to translate a Pilates platform 24 which forms the support surface 28 during use.

Figure 9:
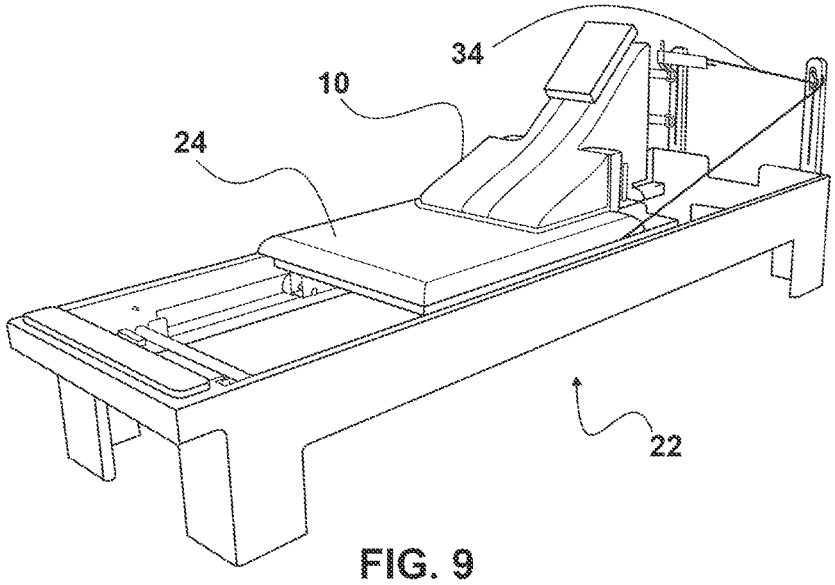
Figure 10:
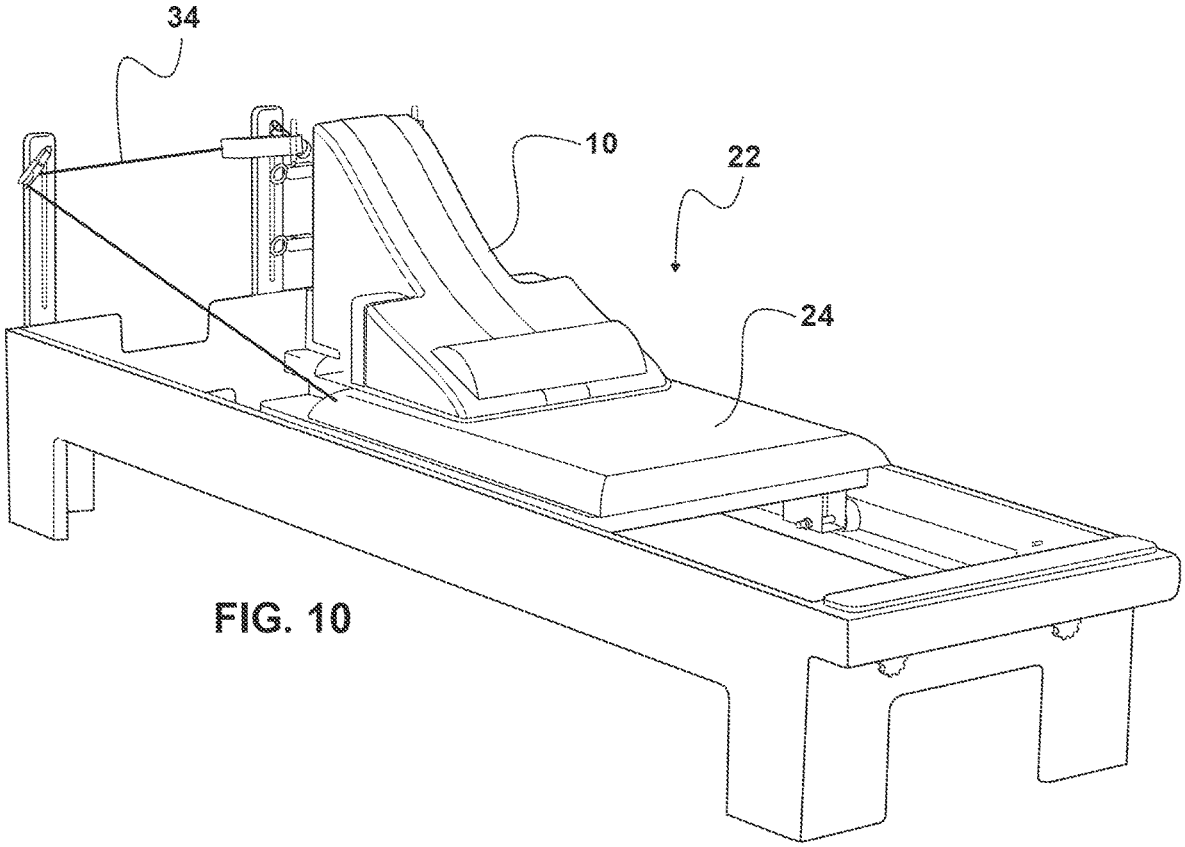
FIG. 10 is another view of the device herein situated as in FIG. 9.
Figure 13:
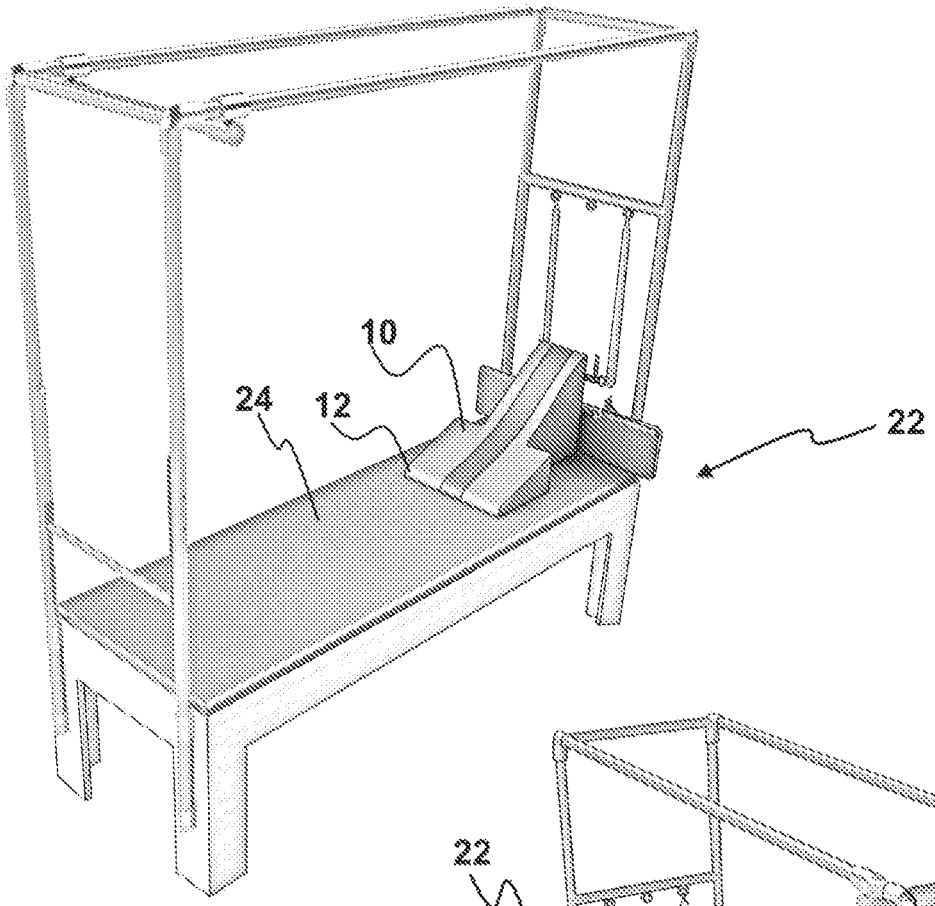
FIG. 13 shows the device herein having the body thereof positioned on the table of a conventional Pilates Trapeze Table.
Figure 14:
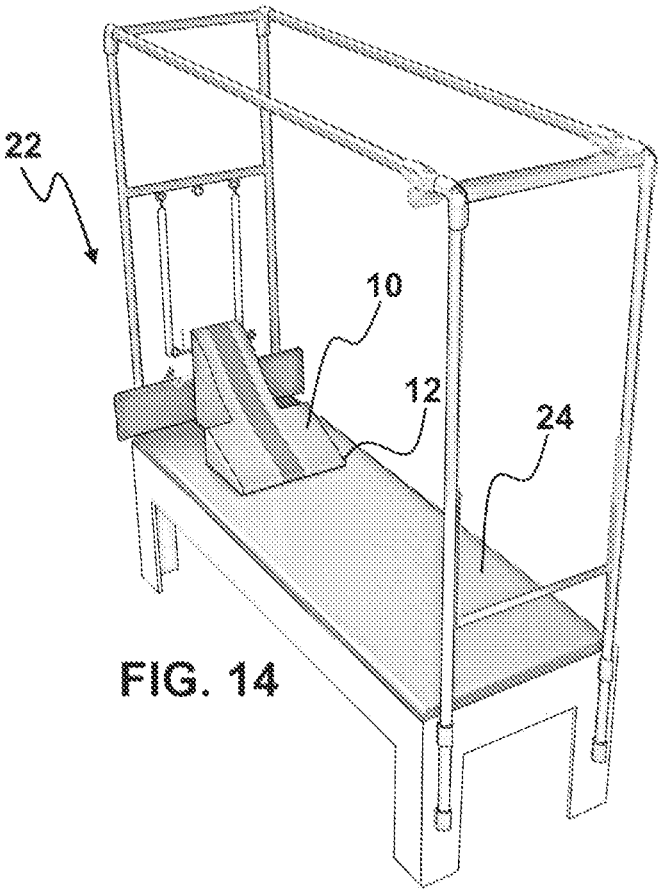
FIG. 14 shows the device as in FIG. 13 from a front perspective overhead view.

As such, when the bottom 14 edge or surface of the body 12 of the device 10 herein is operatively positioned upon a stationary or translating platform 24 of a Pilates exercise device, as for example in FIGS. 9-10, or a stationary platform 24 of a Pilates exercise device, such as in FIGS. 13-14, the device 10 thus provides a user with an inclined support of their back, neck, and head, when positioned on the top surface 16. Also provided, as noted, are the first side space 30 and second side space 32 for positioning and use of their arms while so positioned.

In a method for providing angled or inclined support of the body of users of a Pilates exercise device, for all modes of the device and system herein, in a first step, the health or positioning needs of a user of a Pilates apparatus can be determined. By the term determined is meant that if, either by disclosure on a written form, or disclosure during an oral interview of the user to the provider of the Pilates apparatus, before use of a Pilates apparatus, it is disclosed or determined that the user has a physical limitation, which would make exercise in a fully supine position contraindicated, but would still benefit from similar exercises modified to an inclined position. Such a physical limitation, for example and in no way limiting, can be a determination the user is pregnant or has spine or neck issues.

In a second step, once it is determined the user should employ or can benefit from inclined Pilates exercise, the body 12 of the device 10 herein is positioned with the planar bottom 14 located upon the planar platform 24 of a Pilates Exercise device. Where the device 10 herein is formed as part of a Pilates apparatus which has a platform 24 that pivots or can otherwise be set to provide inclined support of the back and neck, it would be set to such an incline for that user. However, the provision of the device 10 herein for use atop a platform 24 is preferred as it provides the user and provider more options in use of their equipment.

In a third step, with the user operatively positioned upon to top surface 16 of the device 10, the user will thereafter operate the Pilates exercise device in a conventional fashion while supported by the inclining top surface 16 of the body 12 of the device 1*o* herein.

Figure 2:
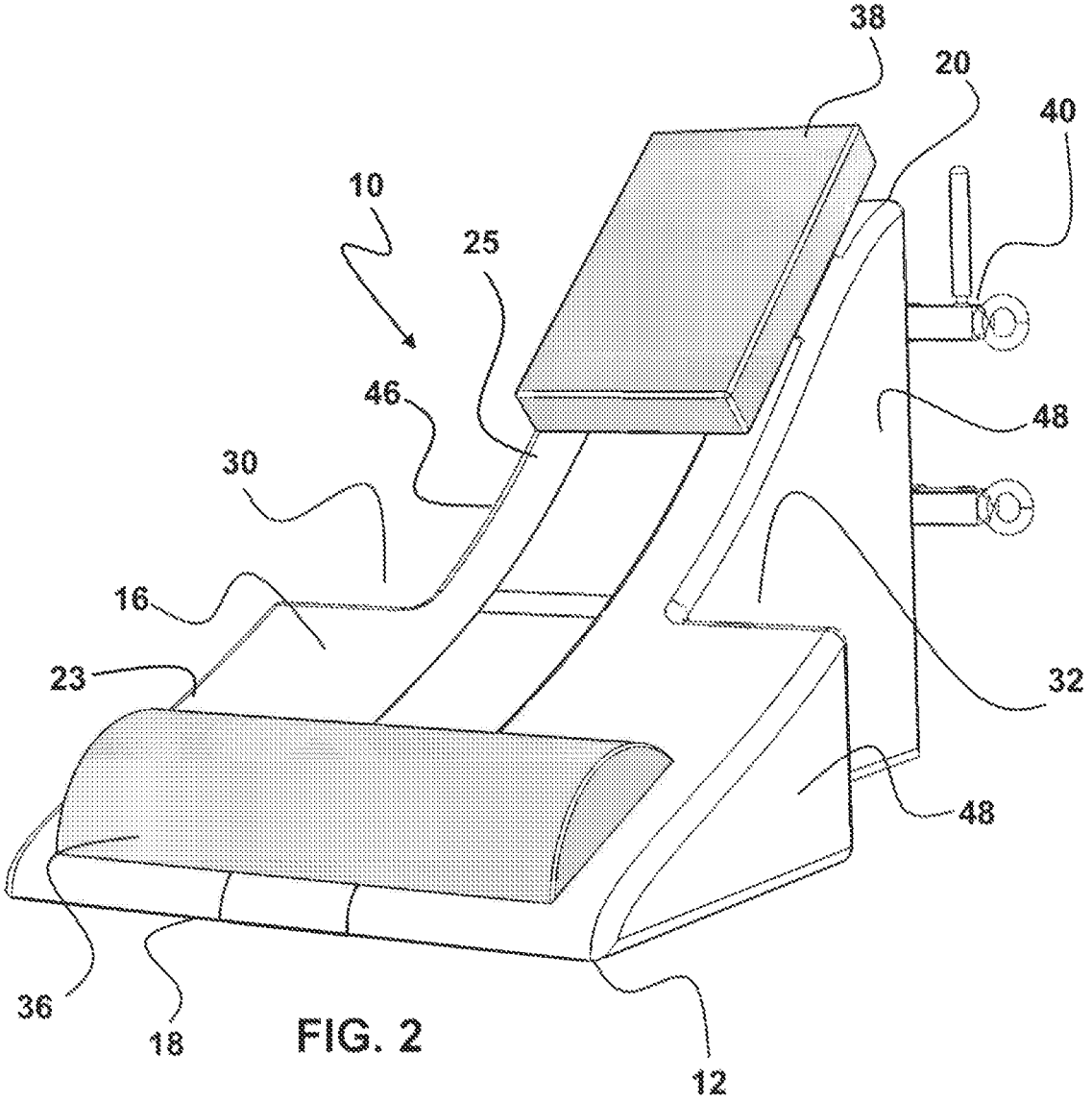
FIG. 2 shows the device of FIG. 1 with both of the engageable components operatively removably engaged to the upper surface.

Also shown in an optional mode of the device 10 herein, in FIG. 2, the device, as in FIG. 1, is depicted with both of the engageable support components such as pads 36 and head supports 38 operatively removably engaged to the top surface 16. Such pads 36 and head supports 38 can be provided in varying thicknesses and dimensions to allow for engagement of such, if needed, to provide additional support to the user.

Figure 3:
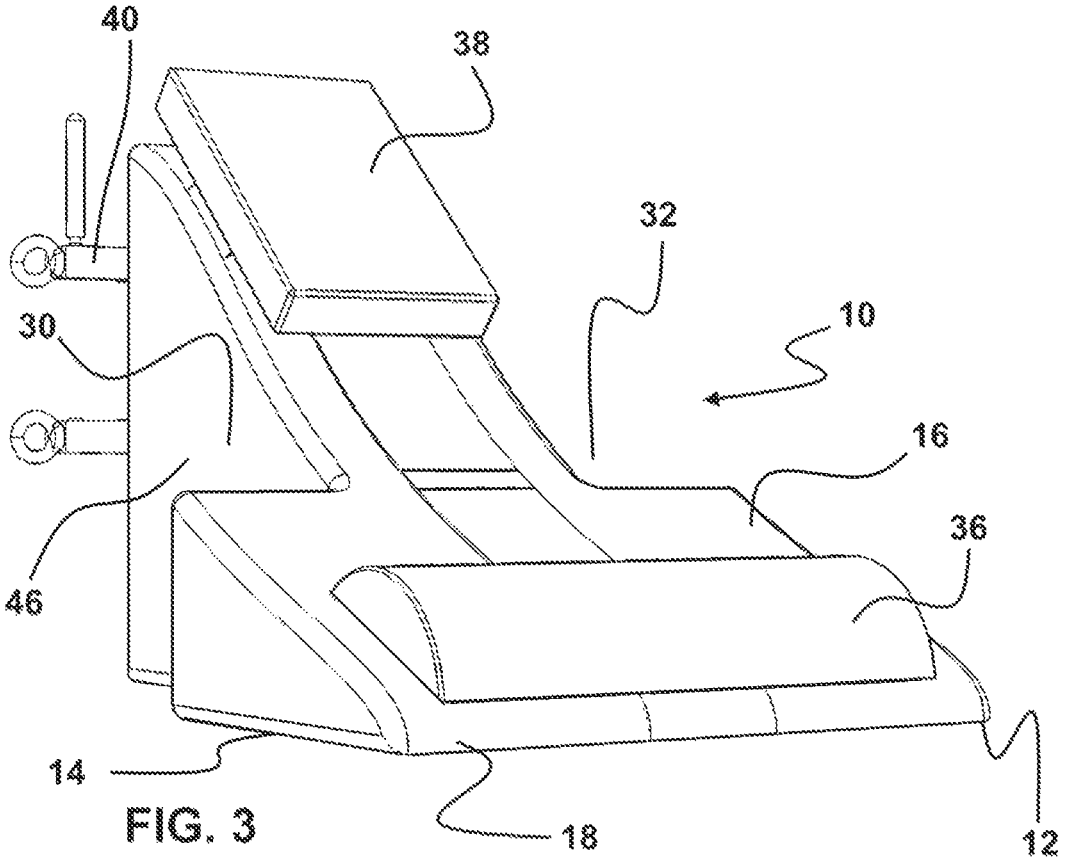
FIG. 3 is another front perspective view of the device showing the body in a perspective view and showing the upper surface inclining from an edge of the base of the body.
Figure 4:
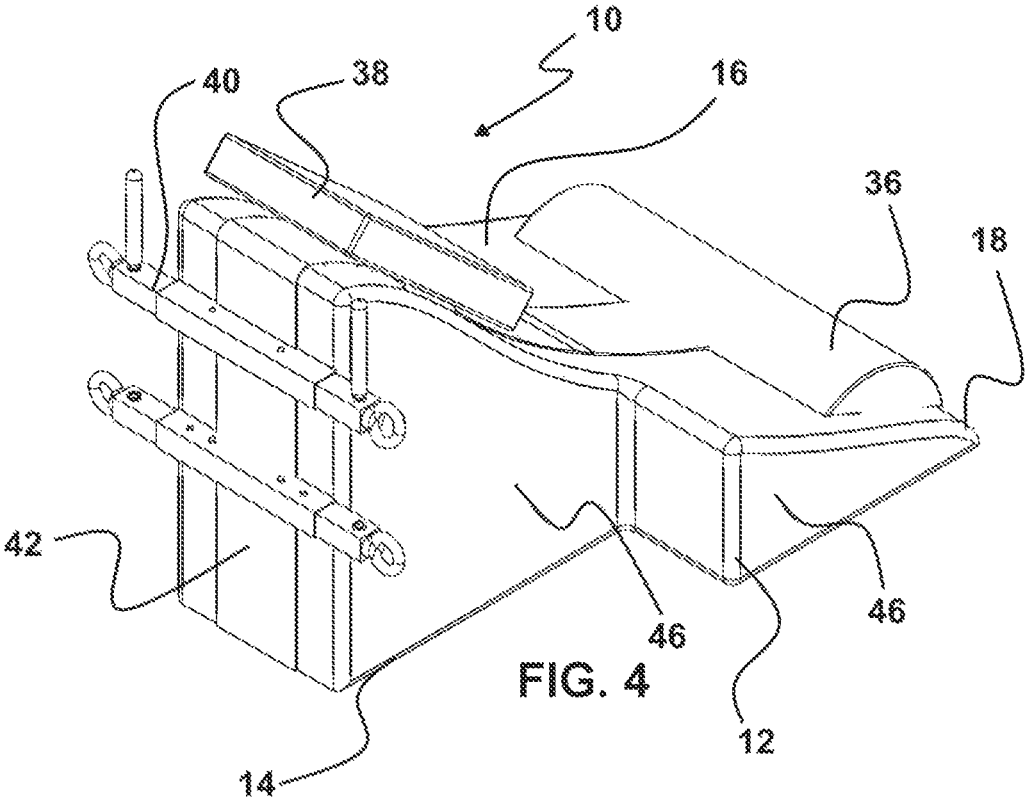
FIG. 4 shows the body of the device, as in FIG. 3, from a rear perspective view.
Figure 5:
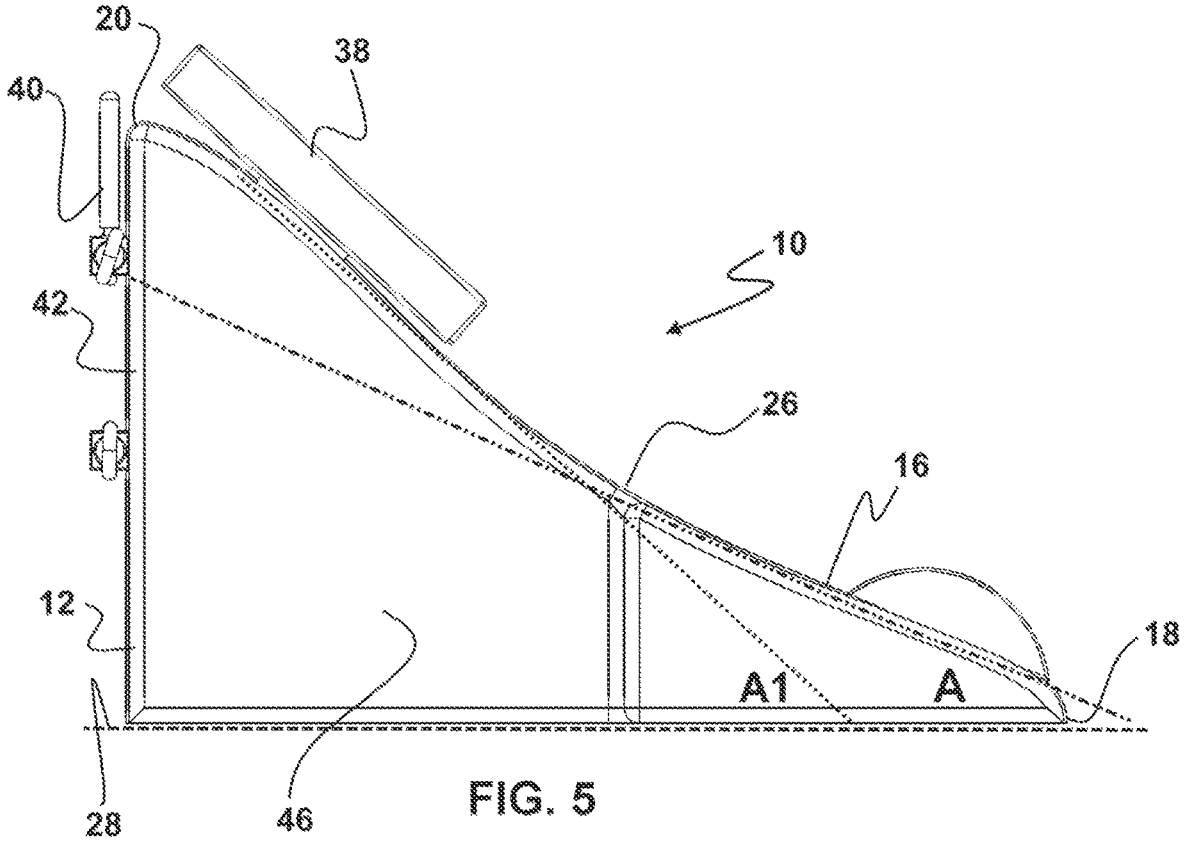
FIG. 5 depicts a side view of the device herein showing the upper surface inclining at substantially angle A as noted above, relative to a base of the body which is configured for positioning on a support surface. Also shown is a recessed area positioned within a central portion of the top surface.
Figure 6:
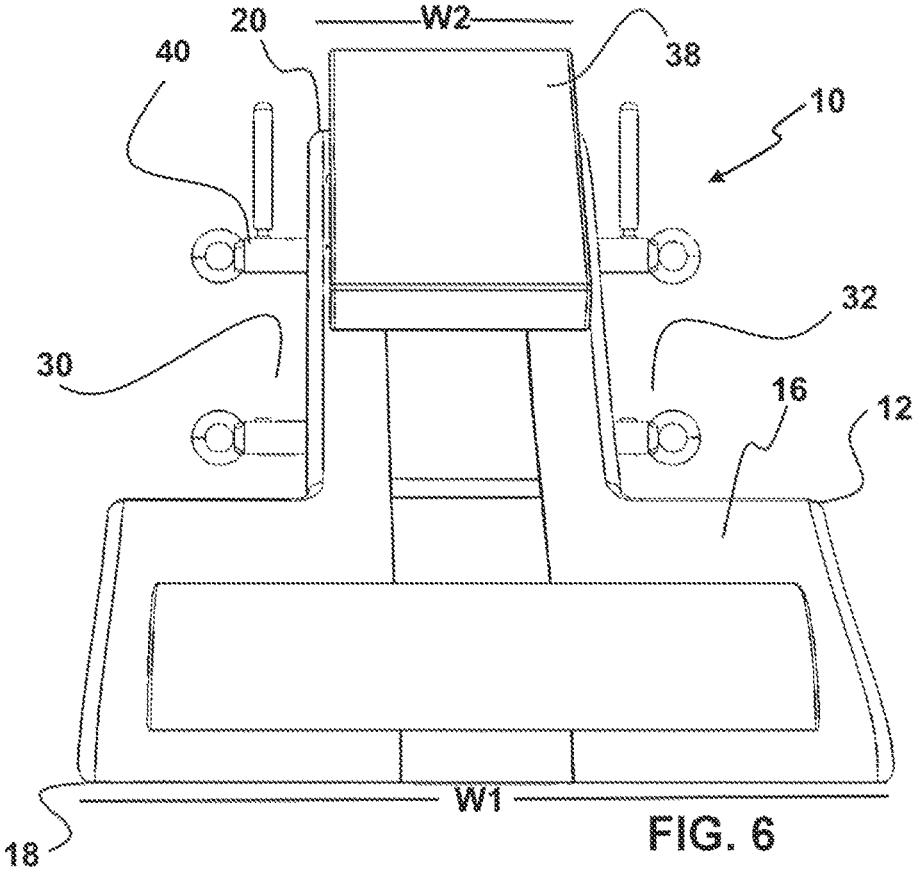
FIG. 6 shows an overhead frontal view of the body of the device having the upper surface inclining from the front edge to the elevated top surface at the rear end and showing removably engageable pads thereon.
Figure 7:
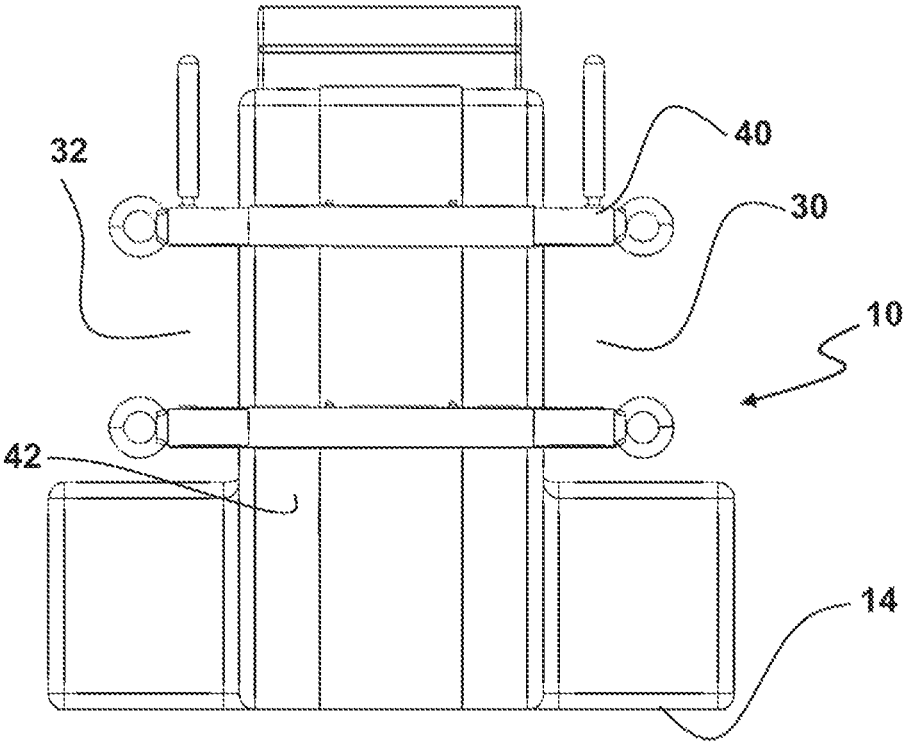
FIG. 7 is a rear view of the body of the device herein showing shoulder portions on opposite sides of a central portion of the top or upper surface of the body of the device.

Additionally shown in FIG. 3 and FIG. 4 are mounts 40 which may be provided with the device 10. The mounts 40 are positioned to provide attachment points for other exercise components such as biasing and resistive elastic bands 33 or pathways for the tethers 34 if needed In FIG. 7 is a view of the rear side of the body 12 of the device 10. As shown, the mounts 40 are engaged to the body 12 along a rear wall 42.

Figure 8:
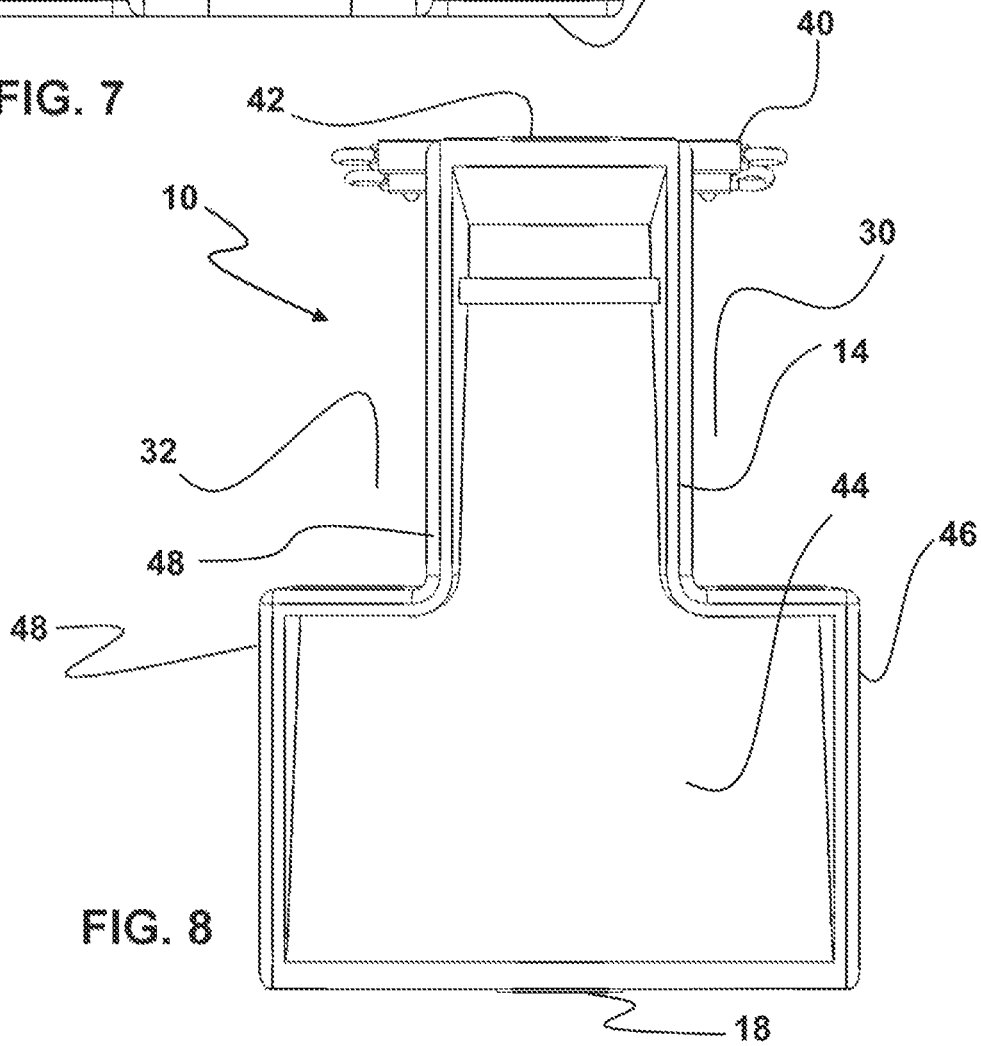
FIG. 8 depicts a bottom view of the device which is shown as being substantially hollow to minimize weight.

Depicted in FIG. 8 is a bottom view of a hollow mode of the body 12 forming the device 18. As shown, where the body is formed of material other than foam or a similar light weight material, as in FIGS. 15-16, to keep the weight to a minimum for easy handling, an interior cavity 44 may be formed in-between a first sidewall 46 and a second sidewall 48 and the rear wall 42. This interior cavity 44 may be left empty or may be filled with foam material or another such light weight material. Where the body 12 is formed totally of open or closed cell foam type material such as Styrofoam, or where the sidewalls, rear wall, and top surface are formed of stronger or stiffer material, such as wood or fiberglass or carbon fiber or the like, the interior cavity 44 may be filled with light weight foam or other material. The exterior surfaces, such as the top surface 16 can be covered with padding or vinyl or other materials, in all modes of the body 12, whether formed of foam in a unitary structure or with sidewall supports.

In FIGS. 9-10, the device 10 herein, where the body 12 is operatively positioned with the base or bottom 14 of the body 12 located on a translating platform 24 or table of a Pilates Reformer or the like or similar Pilates exercise machine 22. So positioned, the user of the Pilates Reformer has their body fully supported in an inclined position while using the Pilates Reformer. So supported, in an inclined position, the user may translate the platform 24 of the Pilates machine 22 in a conventional fashion, using one arm within the first side space 30 and the other within the second side space 32.

Figure 11:
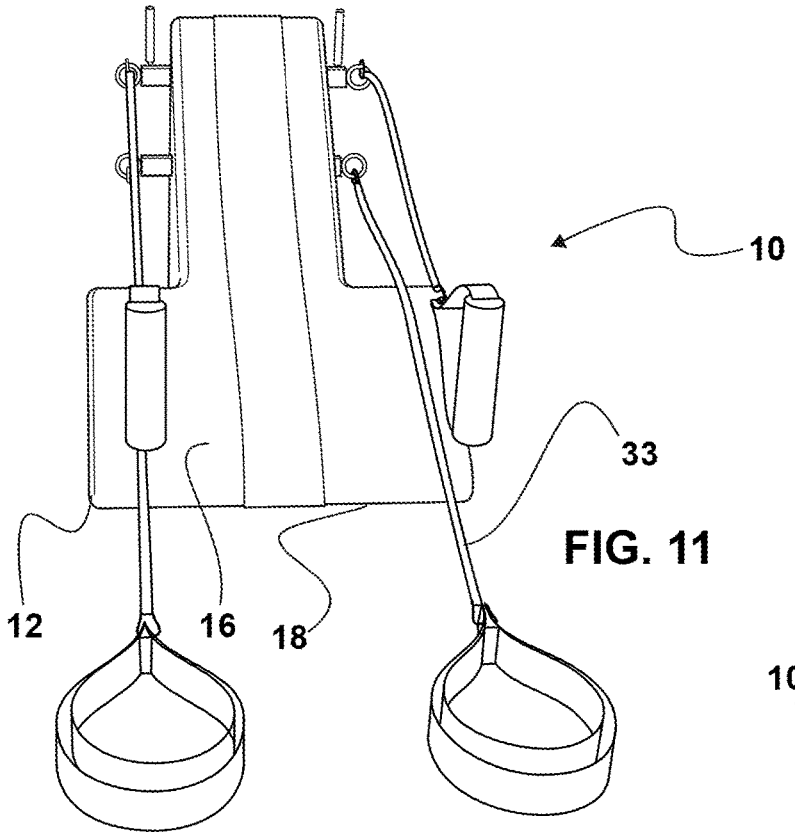
FIG. 11 depicts the device herein from a frontal view showing the body of the device herein which is positionable upon a support surface and also having resistive exercise components operatively connected to mounts.
Figure 12:
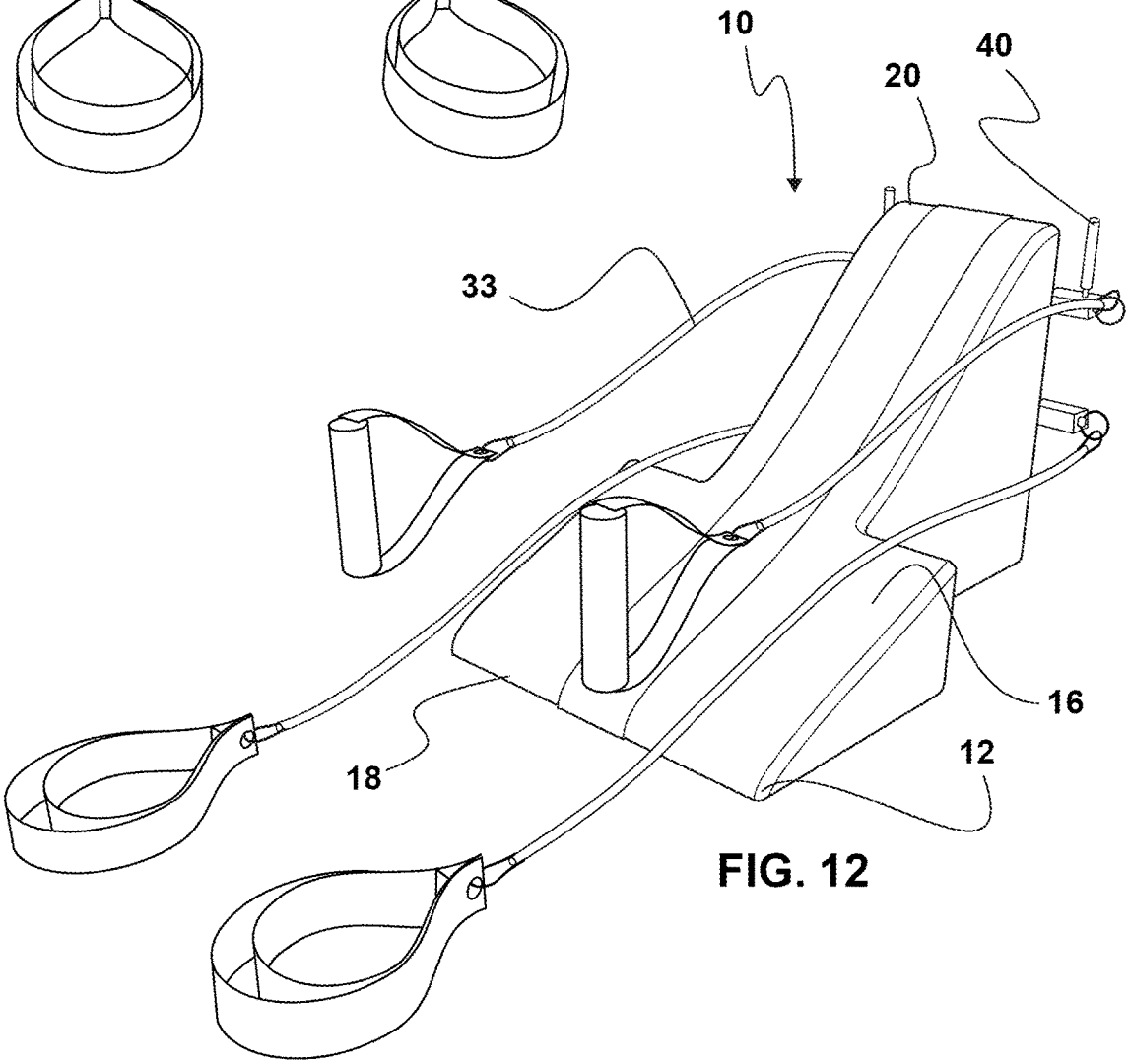
FIG. 12 depicts a perspective view of the device, as in FIG. 11.

In FIGS. 11-12 is shown the body of the device 10 herein from a frontal view. As shown the body 12 of the device 10 is positionable upon a support surface such as a floor or the other depicted platforms 24 of a Pilates exercise machine. Also shown are optional resistive exercise members 33 operatively connected to mounts 40 on the body 12.

In FIGS. 13-14 is shown the body 12 of the device 10 herein operatively positioned on the platform 24 of a conventional Pilates Trapeze Table type Pilates device 22. Such a positioning provides the user of the Trapeze Table support for inclined positioning upon the platform 24 thereof, with the back of the user of the Trapeze Table fully supported in that inclined position.

Figure 15:
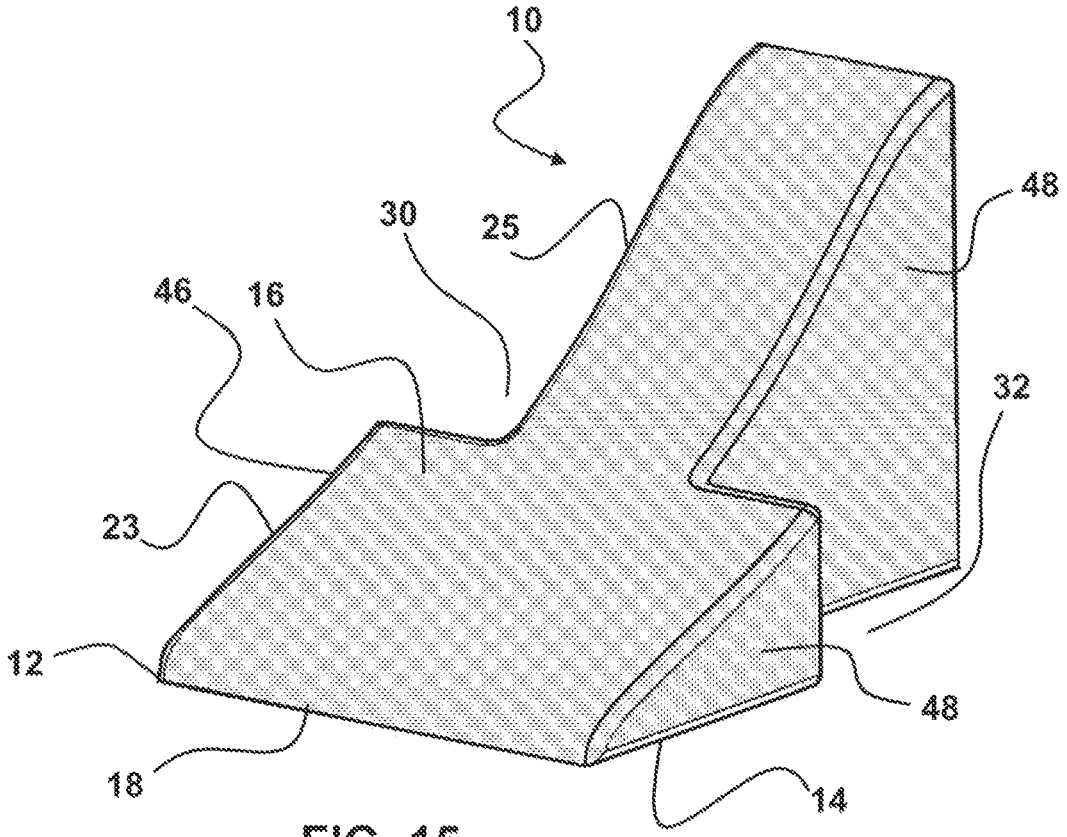
FIG. 15 depicts an overhead perspective view of the device formed from lightweight foam or similar material.

FIG. 15 depicts an overhead perspective view of the device where the body 12 is formed from lightweight foam or similar material. As shown, the body 12 is configured in the same fashion as above where the narrower second body portion 25 extends from a central area of the first body portion 23 from the side thereof opposite the first end 18. By central area is meant an area of the end of the first body portion 23 which is substantially centered between the first sidewall 46 and second sidewall 48 where they are positioned on opposite sides of the first body portion 23.

Figure 16:
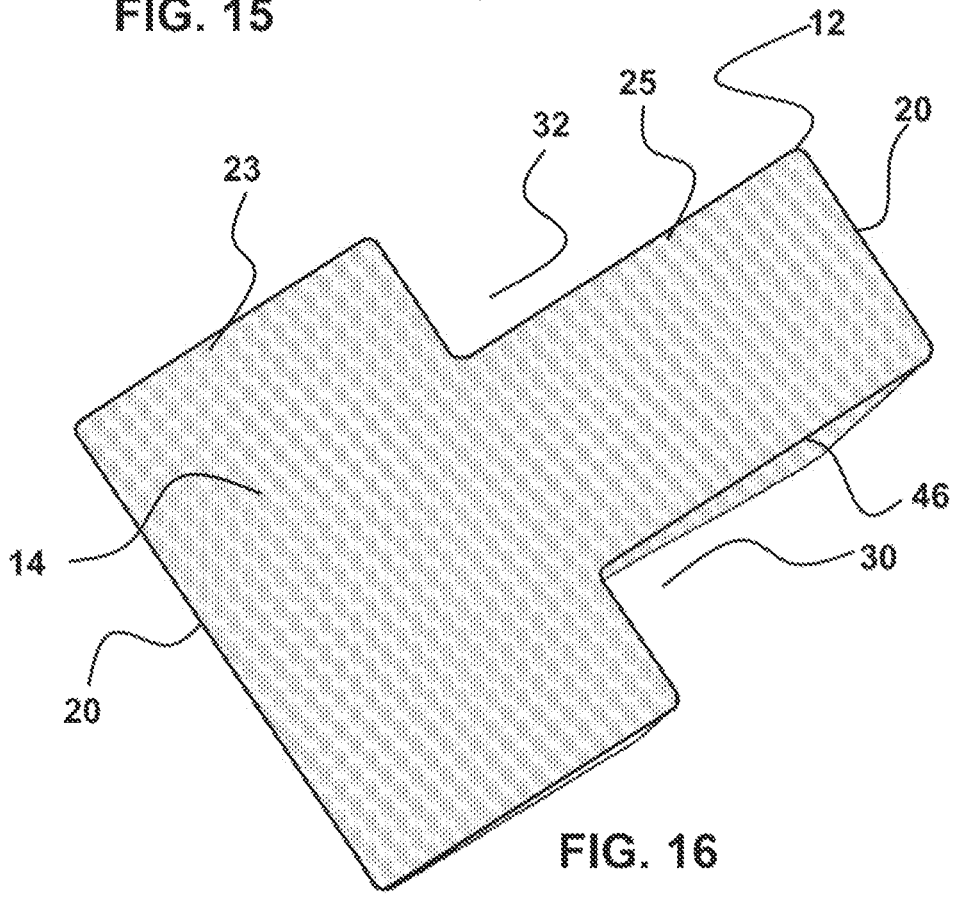
FIG. 16 depicts a bottom view of the device herein, as in FIG. 15, showing the body formed of lightweight material such as foam and having a planar bottom surface.

FIG. 16 depicts a view of the bottom 14 of the body 12 of the device as in FIG. 15. As shown, the body 12 is formed of lightweight material such as a foam material and has a planar bottom 14.

It should be noted that the disclosed Pilates exercise device herein, for providing users an inclined supine positioning of a user as disclosed herein, as either a device or where used in a method, has other applications potentially, and one skilled in the art could discover these, especially upon a reading of this specification. The explanation of the features of this invention does not limit the claims of this application and other applications developed by those skilled in the art are intended to be included in this invention.

It is additionally noted and anticipated that although the Pilates exercise device herein is shown in its most simple form and shape, various components and aspects of the device may be differently shaped or slightly modified when forming the invention herein. As such those skilled in the art will appreciate the descriptions and depictions set forth in this disclosure or merely meant to portray examples of preferred modes of the device herein within the overall scope and intent of the invention, and are not to be considered limiting in any manner.

Further, while all of the fundamental characteristics and features of the invention have been shown and described herein, with reference to particular embodiments thereof, a latitude of modification, various changes and substitutions are intended in the foregoing disclosure as well as the claims which follow, and it will be apparent that in some instances, some features of the post engageable table invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A support apparatus comprising:

a body, said body having a first end opposite a second end thereof;

said body having a top surface opposite a bottom of said body, said top surface extending between said first end and said second end of said body;

said top surface extending at an inclining angle from a first end thereof adjacent said first end of said body, to a second end of said top surface adjacent said second end of said body;

said bottom of said body positionable upon a platform of a Pilates exercise machine to an operative position;

said top surface of said body defining an inclined support for the body of a user positioned thereon, wherein a user of a Pilates exercise machine is provided inclined body support while positioned upon said top surface of said body having said bottom located on the platform;

said body having a first body portion extending from a first side thereof at said first end of said body, to a second side thereof opposite said first side;

said body having a second body portion extending from said second side of said first body portion to said second end of said body;

said first body portion having a first width;

said second body portion having a second width, said second width being narrower than said first width;

a first side space positioned in between said first body portion and said second end of said body;

a second side space positioned in between said first body portion and said second end of said body, said second side space positioned on an opposite side of said second body portion from said first side space; and wherein with said body in said operative position, one arm of said user is positionable within said first side space and the other arm of said user is positionable within said second side space.

2. The support apparatus of claim 1, additionally comprising:

said first width being 2-3 times said second width.

3. The support apparatus of claim 1, additionally comprising:

an internal cavity formed into said bottom of said body.

4. The support apparatus of claim 2, additionally comprising:

an internal cavity formed into said bottom of said body.

5. The support apparatus of claim 1, additionally comprising:

said body formed of a foam material.

6. The support apparatus of claim 2, additionally comprising:

said body formed of a foam material.

7. The support apparatus of claim 1, additionally comprising:

a rear wall at said second end of said body; and a mount positioned upon said rear wall, said mount engageable with elastic tethers which are stretchable by said user for exercise.

8. The support apparatus of claim 2, additionally comprising:

a rear wall at said second end of said body; and a mount positioned upon said rear wall, said mount engageable with elastic tethers which are stretchable by said user for exercise.

9. The support apparatus of claim 5, additionally comprising:

a rear wall at said second end of said body; and a mount positioned upon said rear wall, said mount engageable with elastic tethers which are stretchable by said user for exercise.

10. The support apparatus of claim 6, additionally comprising:

a rear wall at said second end of said body; and a mount positioned upon said rear wall, said mount engageable with elastic tethers which are stretchable by said user for exercise.

11. The support apparatus of claim 1, additionally comprising:

said inclining angle being a first inclining angle substantially between 20-40 degrees.

12. The support apparatus of claim 1, additionally comprising:

said inclining angle being a first inclining angle substantially between 20-40 degrees.

13. The support apparatus of claim 2, additionally comprising:

said inclining angle being a first inclining angle substantially between 20-40 degrees.

14. The support apparatus of claim 12, additionally comprising:

said first inclining angle extending across said top surface of said first body portion being 30-34 degrees; and said top surface of said body on said second body portion extending at a second inclining angle between 35-45 degrees.

15. A method for providing inclined body support for a user of a Pilates exercise machine, using the support apparatus of claim 1, comprising the steps of:

determining if the user of the Pilates exercise machine has a physical limitation which would make exercise lying in a fully supine position upon the platform contraindicated;

positioning said bottom of said body upon said platform;

directing said user to position the back of their body upon said top surface of said body; and having said user exercise upon said Pilates exercise machine.

* * * * *